United States Patent [19]

Micallef

[11] Patent Number: 5,054,659

[45] Date of Patent: Oct. 8, 1991

[54] DOUBLE ACTING PUMP

[75] Inventor: Lewis A. Micallef, Fort Lee, N.J.

[73] Assignee: Leeds and Micallef, Fort Lee, N.J.

[21] Appl. No.: 582,955

[22] Filed: Sep. 26, 1990

[51] Int. Cl.[5] ..... B65D 88/54

[52] U.S. Cl. ..... 222/321; 222/341; 239/333

[58] Field of Search ..... 222/321, 340, 341, 380, 222/383, 385; 239/333; 417/509, 554

[56] References Cited

U.S. PATENT DOCUMENTS

| | | | |
|---|---|---|---|
| 3,531,224 | 9/1970 | Clevenger et al. | 222/321 X |
| 3,583,605 | 6/1971 | Corsette | 222/383 |
| 4,591,077 | 5/1986 | Corsette | 222/340 X |
| 4,646,969 | 3/1987 | Sorm et al. | 239/333 X |
| 4,826,052 | 5/1989 | Micallef | 222/321 |

*Primary Examiner*—Michael S. Huppert
*Assistant Examiner*—Gregory L. Huson
*Attorney, Agent, or Firm*—Kane Dalsimer Sullivan Kurucz Levy Eisele

[57] ABSTRACT

A double acting trigger pump on a container includes a cylinder and a piston reciprocal therein that cooperate in providing a primary pump chamber. An inlet valve regulates product being drawn into the primary pump chamber. A double piston seal is at the inner end of the piston and includes an outlet valve coaxial with a longitudinal bore in the piston. A supplemental pump chamber that also communicates with the bore is defined between outer surfaces of the piston and inner surfaces of the cylinder as well as the double piston seal and a rearward retaining ring. During the pressure stroke of the piston, product is dispensed from the primary pump chamber out from the pump and fills the supplemental pump chamber. During the suction stroke of the piston, product is drawn into the primary pump chamber from the container and product is discharged from the supplemental pump chamber out from the pump.

23 Claims, 3 Drawing Sheets

DOUBLE ACTING PUMP

BACKGROUND OF THE INVENTION

A need for improved trigger sprayers and particularly double acting trigger sprayers has been clearly established in the packaging industry. However, the object has always been to develop a trigger sprayer that is cost effective and possesses a more forceful spray and greater output per stroke which could be readily adjusted. Of course such trigger pumps should preferably not be restricted to particular products to be dispensed and should possess the ability to dispense petroleum based products. Pumps of this variety because of consumer preference, must possess eye appeal to be commercially feasible.

SUMMARY OF THE INVENTION

A principal object of the present invention is to provide a cost effective, reliable, double acting trigger actuated piston pump with the foregoing characteristics that permits a full stroke with relatively more leverage but with comfort for high volume delivery during both the pressure and suction strokes at relatively high pressure without concern over product compatibility while being a shipper which lends to its commercial acceptability.

DETAILED DESCRIPTION

Figure 1:
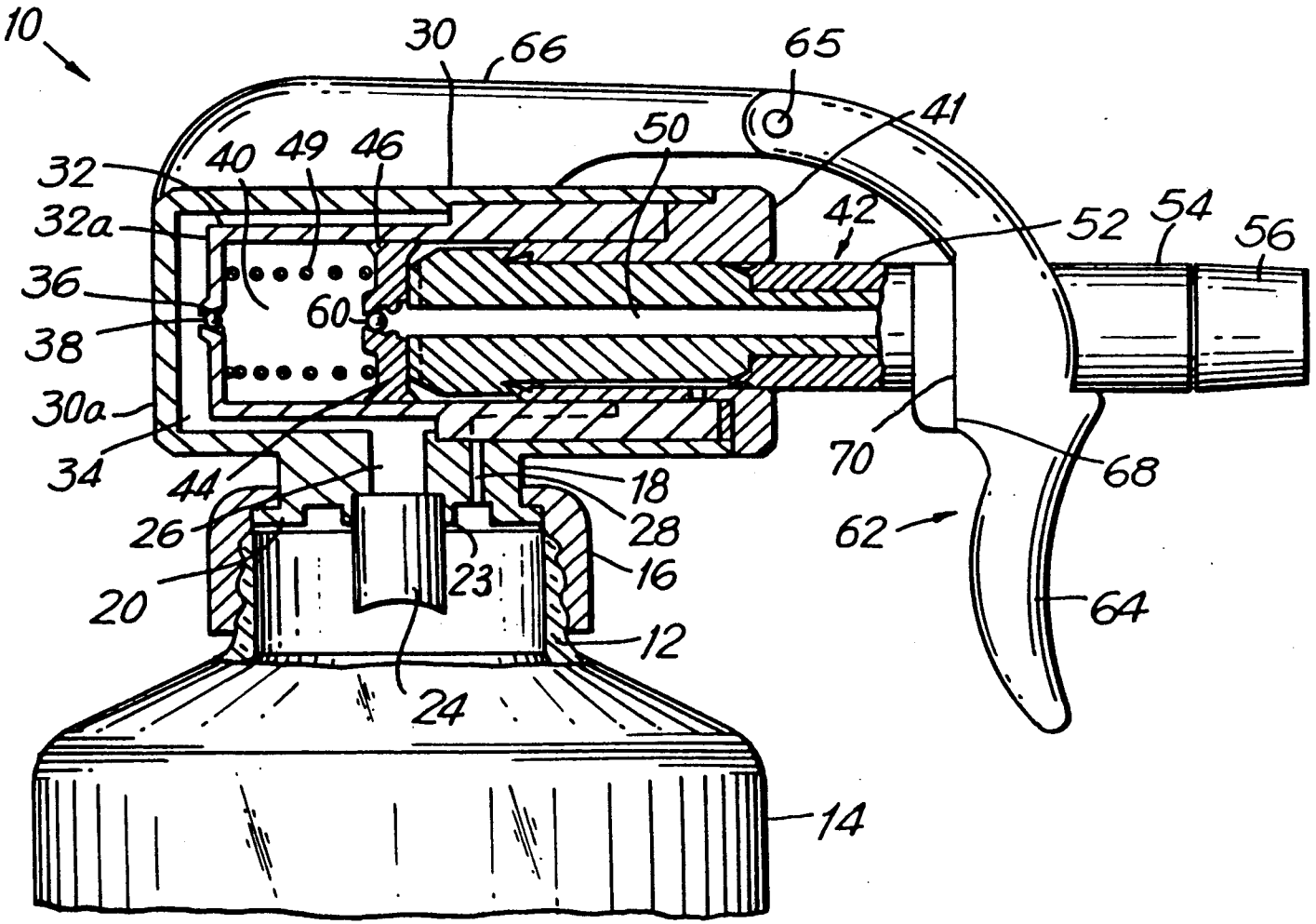
FIG. 1 is a side elevational view of the double acting trigger actuated pump of this invention at the start of the pressure stroke with certain parts broken and removed and sectioned.

In the drawings a double acting trigger actuated pump 10 is shown associated with the threaded neck 12 of container or bottle 14 containing the product to be dispensed. Towards this end an internally threaded cap 16 extends across the opening of the neck 12 and threadedly mates therewith in securing the pump 10 on bottle 14. The cap 16 secures the pump base 18 and seals it across the opening of the neck 12 by engaging the circumferentially extending lip 20. Base 18 includes a downwardly depending boss 22 which supports dip tube 24, which communicates with passage 26 for product flow. The base is also provided with vent opening 28 cooperating in venting the head space of the bottle 14.

The pump 10 is provided with an outer shell 30 and a concentric inner shell 32 both supported on base 18 and both having a closed inner end **30*a* and 32*a* respectfully. The outer shell 30 and inner shell 32 define a product chamber 34 which communicates with passage 26 for reception of product to be dispensed. The vent opening 28 extends through the inner shell 32 for eventual communication with the atmosphere as will be described shortly. The inner end 32*a* of inner shell 32 is provided with a valve seat 36 which receives a ball check valve 38 for closing off pump chamber 40 within inner shell 32 and isolating it from the product chamber 34 during the pressure stroke. The valve 38 will open to permit product to enter the primary pump chamber 40 from the product chamber 34 during the suction stroke. The outer open ends of the outer shell 30 and inner shell 32 are provided with a retaining ring 41 which retains a spaced concentrical relationship of the shell parts and at the same time cooperates in maintaining the coaxial relationship of the piston 42. More importantly, this retaining ring 41 cooperates with the piston 42 and providing a supplemental pump chamber which contributes to the double action of the pump 10**.

The piston 42 includes an inner double piston seal 44 having a pair of sealing lips 46 and 48 which form sliding seals with the interior of the inner shell 32. The piston 42 is also provided with a coaxial bore 50 in the piston rod 52. The piston rod is provided with a sealing lip 53 which engages with the retaining ring 41 in sealing the vent opening 28 when the pump is in its shipping condition as depicted in FIG. 1. A piston return spring 49 is biased against the double piston seal 44 and the inner shell wall **32*a*. It is also contemplated that this spring could be readily externally mounted. The outer end 54 of the piston rod 52 mounts a discharge nozzle 56** which may be of any suitable design to generate the desired discharge patterns.

The double piston seal 44 is provided with a valve seat 58 coaxial with the bore 50 in the piston rod and cooperates with a ball check valve 60. The valve 60 assumes a closed position during the suction stroke and unseats during the pressure stroke.

In order to activate the piston 42, a trigger mechanism 62 is employed. The trigger mechanism 62 includes a trigger 64 suitably pivoted at 65 to the trigger support 66 which may be integral with the outer shell 30. The trigger 64 is provided with an actuator surface 68 designed to engage piston actuated plate 70 extending laterally from piston rod 52. The zone of engagement of the trigger surface 68 and the plate 70 is of a sliding nature to provide as near as possible, a direction of force parallel to the axis of the piston rod 52 as the trigger 64 is pulled and the piston 42 is moved axially from its retracted position to its forward position during the pressure stroke.

In order to obtain dispensing or discharge of product during the suction stroke, a supplemental pump chamber 74 is defined between exterior surfaces of the piston rod 52 and internal surfaces of the inner shell 32 and the internal sealing lip 76 of the retaining ring 41. Access to the supplemental pump chamber 74 is obtained through lateral passages 78 at the forward end of the piston rod 52 and a clearance 80 between forward circumferentially extending surfaces of the piston rod 52 and internal surfaces of the inner shell 32.

Figure 2:
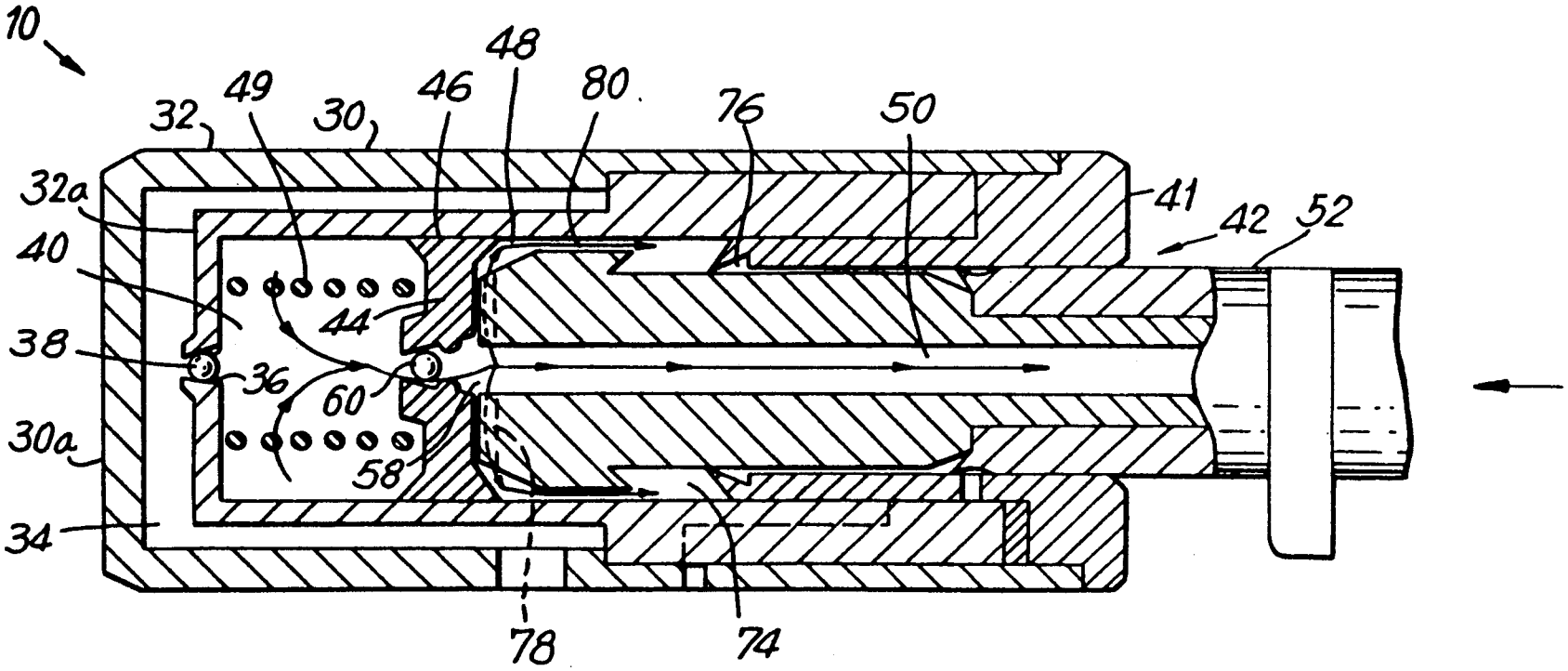
FIG. 2 is a similar view during the pressure stroke with the bottle head space cable of being vented with product being dispensed from the pump chamber.

In operation of the pump 10, it will be assumed that initially, the pump will be fully primed with product to be dispensed in the primary pump chamber 40 and the piston 42 is in its fully retracted position as shown in FIG. 1. In this position, which is also the end of the suction stroke or start of the pressure stroke, the ball 38 will be sealed against seat 36, the vent 28 will be closed to the atmosphere. In order to dispense product, the trigger 64 will be pulled and the sliding engagement of the actuation surface 68 against the plate 70 will force the piston rod 52, and, consequently, the double piston seal 44 forwardly as shown in FIG. 2. This movement will initiate the pressure stroke with the product being forced out of the chamber 40, bypassing unseated ball valve 60, through bore 50 out through the nozzle 56 and into the desired discharged pattern onto the selected surface. In addition product will flow through the lateral passages 78 through clearance 80 into the supplemental pump chamber 74. As the trigger 64 is pulled further causing the double piston seal 44 to bottom in the pump chamber 40 if this be the desired or selected stroke of the piston. It will be noted that during this movement, the vent passage 28 will be opened to vent the container headspace to atmosphere to replace product dispensed with air.

Figure 3:
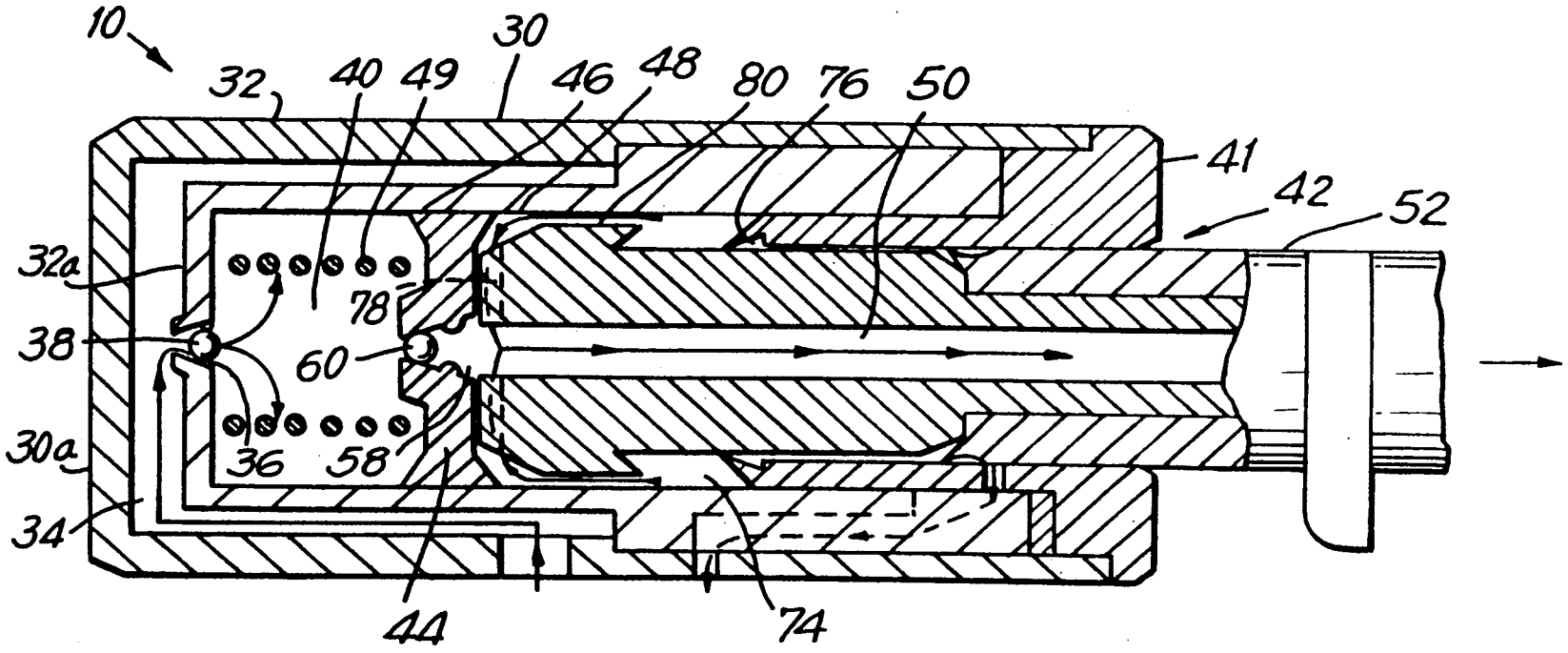
FIG. 3 is a similar view during the suction stroke with the product drawn into the primary pump chamber with the product being dispensed from the supplemental pump chamber.

At the start of the suction stroke, the trigger mechanism 62 is released, and the spring 49 biased against inner shell wall 32*a* and double piston seal 44, will urge the piston 42 to its retracted position as shown schematically in FIG. 3. The valve 60 will close against its seal 58 and inlet valve 38 will open. The product in the container 14 will be forced up dip tube 24 into passage 26 and chamber 34 passed the valve 38 into primary pump chamber 40. During the retraction of the piston 42, product in the supplemental pump chamber 74 will be forced through the clearance 80 into lateral passages 78 through bore 50 and out through the nozzle 56. Eventually, the piston 42 will approach its fully retracted position at which the desired amount of product will be pulled into primary pump chamber 40 and the product in supplemental pump chamber 74 will be discharged. This a fully retracted position is represented by FIG. 1 with both valves 38 and 60 seated and closed and vent 28 closed. The pump 10 is now ready for another pressure stroke.

Accordingly, the foregoing pump characteristics, objects and advantages are most effectively attained. Thus a double acting trigger actuated pump is provided with:

1) higher adjustable pump pressure;
2) longer adjustable trigger stroke;
3) greater adjustable pump volume;
4) a vent that is sealable directly to the chamber;
5) adjustable trigger leverage;
6) adjustable pump chamber diameter;
7) no pump leakage;
8) pump centered on neck of container; and,
9) ability to use a shroud over pump if desired.

Thus the several aforenoted objects and advantages are most effectively attained. Although a single somewhat preferred embodiment has been disclosed and described in detail herein, it should be understood that this invention is in no sense limited thereby and its scope is to be determined by that of the appended claims.

I claim:

1. A double acting dispensing pump for dispensing product from the container, the pump serving as a container closure comprising:

a cylinder having a forward end and rearward end having an inner shell open at its rear end and closed at its forward end, and an outer shell surrounding the inner shell and defining a cavity there between;

a piston having a forward end rear end and being reciprocally mounted in the inner shell and defining a primary pump chamber therewith, and the piston being relatively reciprocal through a pressure stroke from an extended position to an inserted position and through a suction stroke from an inserted position to the extended position;

inlet port means including a passage in the outer shell for cooperating in communicating the container interior with the primary pump chamber during the suction stroke to permit product to pass through the inlet port means into the cavity and then into the pump chamber;

outlet port means for product to be dispensed under pressure from the primary pump chamber during the pressure stroke;

venting means for replacing product removed from the container interior into the pump chamber with air;

a supplemental pump chamber defined by cooperating surfaces of the inner shell and the piston;

supplemental port means for communicating the supplemental pump chamber with the outlet port means;

outlet valve means at the forward end of the piston for communicating the primary pump chamber with the outlet port means during the pressure stroke for directing product from the primary pump chamber through the outlet port means and for directing product through the supplemental port means into the supplemental pump chamber, the outlet valve means operating to seal the communication between the primary pump chamber and the outlet port means during the suction stroke while permitting product in the supplemental pump chamber to be directed to the supplemental port means through the outlet port means; and inlet valve means for opening the inlet port means during the suction stroke and for closing the inlet port means during the pressure stroke.

2. The invention in accordance with claim 1 wherein the inner and outer shells are concentric tubular members connected substantially at the open rear ends.

3. The invention in accordance with claim 1 wherein a retaining ring is provided at the rear open end of the inner and outer shell and includes a sealing lip at its forward end that cooperates with the inner shell and outer surface of the piston in defining the supplemental pump chamber.

4. The invention in accordance with claim 3 wherein a double piston seal is at the forward end of the piston and cooperates with the retaining ring inner shell and outer surfaces of the piston in defining the supplemental pump chamber.

5. The invention in accordance with claim 1 wherein the inlet valve means is disposed at the forward end of the inner shell.

6. The invention in accordance with claim 5 wherein the forward end of the inner shell includes an opening communicating the pump chamber with the cavity, the inlet valve means includes a valve seat and a ball coupled with a seal for opening and closing the inner shell opening.

7. The invention in accordance with claim 1 wherein the vent means includes a passageway through the cylinder and communicates the interior of the container with the atmosphere during the reciprocation of the piston and the passageways adapted to be sealed from the atmosphere by the piston when the piston is in a fully extended retracted position.

8. The invention in accordance with claim 7 wherein the passageway extends into the outer and inner shells.

9. The invention in accordance with claim 1 wherein the piston includes a longitudinally extending bore forming part of the outlet port means and communicates the pump chamber with the ambient.

10. The invention in accordance with claim 9 wherein a nozzle is coupled with the rear end of the piston for directing the product to be dispensed in a predetermined spray pattern as it emerges therefrom.

11. The invention in accordance with claim 1 wherein the piston forward end is provided with a double piston seal which cooperates in sealing the primary pump chamber and supplemental pump chamber during reciprocation of the piston.

12. The invention in accordance with claim 11 wherein the outlet valve means is located in the double piston seal.

13. The invention in accordance with claim 1 wherein the passage of the inlet port means is adapted to be substantially coaxially located within the neck of the container.

14. The invention in accordance with claim 13 wherein a dip tube is coupled with the passage.

15. The invention in accordance with claim 14 wherein a pump base extends outwardly from the outer shell and includes the passage and a cap means coupled with the base for coupling the pump to the neck of the container.

16. The invention in accordance with claim 1 wherein a trigger mechanism is coupled with the piston for reciprocating the piston between the extended and inserted position.

17. The invention in accordance with claim 16 wherein the trigger mechanism includes a trigger having a upper and a lower end, pivot means pivotally connecting the upper end of the trigger to an upper extension of the outer shell, a finger engaging surface on the lower end of the trigger for digital engagement, a piston actuation means on the piston intermediate the piston ends for sliding engagement with the trigger to thereby minimize turning moments on the piston as it is reciprocated by movement of the trigger when the trigger is digitally engaged at its lower end to pivot the trigger about the trigger means.

18. The invention in accordance with claim 17 wherein the piston actuator means is a laterally extending plate engaged by the trigger.

19. The invention in accordance with claim 18 wherein biasing means urges the piston towards its extended position, the bias is adapted to be overcome by pulling the trigger upon digital engagement of the trigger lower end.

20. The invention in accordance with claim 19 wherein the biasing means is a spring extending between the inner end of the inner shell and forward end of the piston.

21. A double acting dispensing trigger pump for dispensing product from the container, the pump serving as a container closure comprising:

a cylinder having a forward end and rearward end having an inner shell open at its rear end and closed at a forward end, and an outer shell surrounding the inner shell and defining a cavity there between;

a piston having a forward end rear end and being reciprocally mounted in the inner shell and defining a primary pump chamber therewith, and the piston being relatively reciprocal through a pressure stroke from an extended position to an inserted position and through a suction stroke from an inserted position to the extended position;

inlet port means including a passage in the outer shell for cooperating in communicating the container interior with the primary pump chamber during the suction stroke to permit product to pass through the inlet port means into the cavity and then into the pump chamber;

outlet port means for product to be dispensed under pressure from the primary pump chamber during the pressure stroke;

venting means for replacing product removed from the container interior into the pump chamber with air;

a supplemental pump chamber defined by cooperating surfaces of the inner shell and the piston;

supplemental port means for communicating the supplemental pump chamber with the outlet port means;

outlet valve means at the forward end of the piston for communicating the primary pump chamber with the outlet port means during the pressure stroke for directing product from the primary pump chamber through the outlet port means and for directing product through the supplemental port means into the supplemental pump chamber, the outlet valve means operating to seal the communication between the primary pump chamber and the outlet port means during the suction stroke while permitting product in the supplemental pump chamber to be directed to the supplemental port means through the outlet port means;

outlet valve means for opening the inlet port means during the suction stroke and for closing the inlet port means during the pressure stroke;

a trigger mechanism coupled with a piston for reciprocating the piston between the extended and inserted position;

the piston including a longitudinally extending bore forming part of the outlet port means and communicating the primary pump chamber with the ambient, the piston including a double piston seal at its forward end having a valve seat coaxial with the bore of the piston and forming part of the outlet valve means;

a retaining ring coupling the rear open end of the inner and outer shells and surrounding the piston, the retaining ring having a forward sealing lip which cooperates with the double piston seal, inner shell and outer surfaces of the piston in defining the supplemental pump chamber.

22. The invention in accordance with claim 21 wherein the forward end of the piston includes lateral passageways communicating with the outlet port means, a clearance between the piston and the inner shell that communicates the lateral passageways with the supplemental pump chamber, whereby when the pump piston is fully extended at the start of the pressure stroke, the inlet valve is closed and the outlet valve is closed, when the trigger mechanism is actuated to initiate the pressure stroke the inlet valve remains closed and the outlet valve opens to permit product to bypass it and flow out through the outlet port means to discharge the product from the pump and simultaneously direct product to the lateral passageways through the clearance into the supplemental pump chamber, and when the product has been fully dispensed at the end of the pressure stroke, and the piston is retracted the inlet valve opens to permit product to pass into the primary pump chamber from the container and at the same time the outlet valve closes, upon retraction of the piston product in the supplemental pump chamber will be forced out through the lateral passageways through the clearance out through the bore of the piston to be discharged from the pump.

23. The invention in accordance with claim 22 biasing means urges the piston outwardly to its retracted position during the suction stroke to facilitate discharged product from the supplemental pump chamber.

* * * * *